United States Patent [19]

Oda

[11] Patent Number: 4,636,178

[45] Date of Patent: Jan. 13, 1987

[54] RECHARGEABLE TOY ELECTRIC VEHICLE SET

[75] Inventor: Nobuo Oda, Tokyo, Japan

[73] Assignee: Takara Co., Ltd., Tokyo, Japan

[21] Appl. No.: 567,794

[22] Filed: Jan. 3, 1984

[30] Foreign Application Priority Data

Feb. 9, 1983 [JP] Japan ..... 58-17690[U]
Sep. 14, 1983 [JP] Japan ..... 58-170080

[51] Int. Cl.[4] ..... A63H 29/02
[52] U.S. Cl. ..... 446/462; 446/471
[58] Field of Search ..... 446/462, 463, 457, 471, 446/470, 465, 484, 485, 433, 434, 438, 439, 429, 431

[56] References Cited

U.S. PATENT DOCUMENTS 3,350,813 11/1967 Isaacson ..... 446/462
3,540,151 11/1970 Ishida ..... 446/462 X
3,629,680 12/1971 Baynes et al. ..... 446/484 X

*Primary Examiner*—Mickey Yu
*Attorney, Agent, or Firm*—Price, Gess & Ubell

[57] ABSTRACT

A miniature electric toy vehicle having a chassis of approximately the same upper and lower configuration is provided for removably receiving a vehicle body. A miniature rechargeable battery can be connected to an operator controlled source of power for periodic recharging of the battery. The toy vehicle approximates the size of the battery and motor and can operate with a minimal recharge time period to enhance the play value for a child.

12 Claims, 11 Drawing Figures

FIG. 2
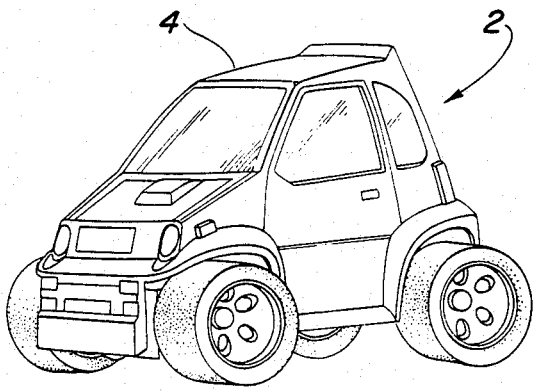
FIG. 6
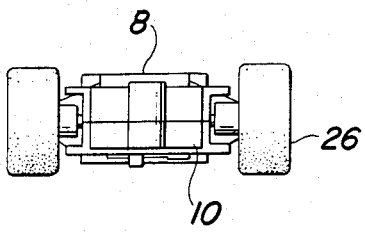
FIG. 7
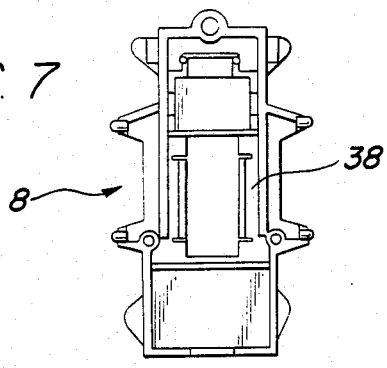
FIG. 8
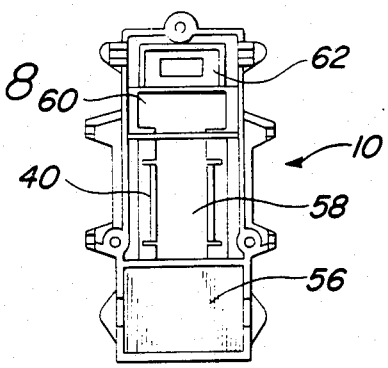
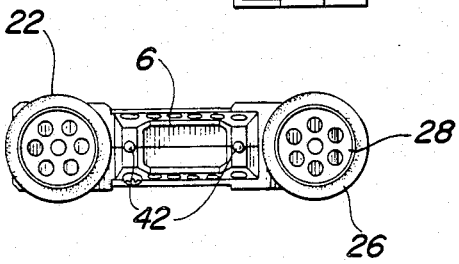
FIG. 4
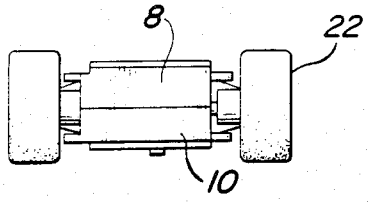
FIG. 5
FIG. 3
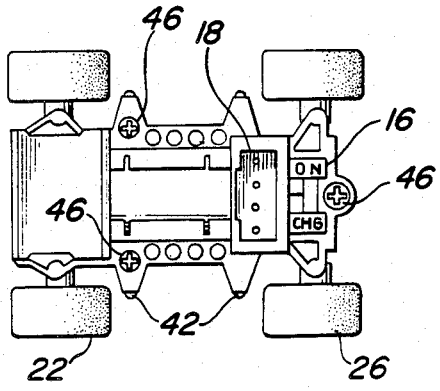

RECHARGEABLE TOY ELECTRIC VEHICLE SET

BACKGROUND OF THE INVENTION

1. Field of the Invention

The present invention provides a rechargeable small toy electric vehicle set capable of interfacing with different vehicle bodies, and more particularly a rechargeable electrical toy vehicle that is not much bigger than the rechargeable battery itself and capable of being charged from conventional batteries.

2. Description of the Prior Art

Toy vehicles that have been driven by rechargeable batteries are well known in the toy field and have been known for a long period of time. Numerous examples of such toy vehicles can be found in the prior art, such as the Mueller U.S. Pat. No. 2,832,177. This reference teaches a toy vehicle with a rechargeable battery that can be reactivated from an AC-DC transformer. A simulated gas station pump is utilized as the actual electrical connector for recharging the battery. The Soulakis et al. U.S. Pat. No. 3,628,284 discloses a toy vehicle carrying a rechargeable battery that also can be charged from a conventional power source. The White et al. U.S. Pat. No. 3,503,151 and Benkoe U.S. Pat. No. 3,218,757 are of interest to disclose various toy vehicles having battery driven electrical motors.

There is still a need in the toy field to provide an extremely small and inexpensive electrical toy vehicle that can be recharged from a relatively inexpensive and convenient power source such as conventional DC batteries. The present invention seeks to offer such a toy vehicle to provide an innovative and stimulating toy for children.

SUMMARY OF THE INVENTION

The present invention provides an extremely small electrical toy vehicle comprising a chassis having an upper and lower portion, front and rear wheel assemblies including axles and wheels, a rechargeable miniature battery mounted along the longitudinal axis of the chassis, an electrical motor mounted traverse to the chassis of the axis, a connector with terminals for attachment to a power line, and a manual slide switch for disconnecting the rechargeable battery from the electrical motor during a charging mode of operation and reconnecting it for transportation of the vehicle across a support surface during a play mode of action. The chassis member is not much thicker nor longer than the combination of the rechargeable battery, switch, terminal connector and electric motor. The vehicle includes a pair of front and rear wheels of a diameter greater than the thickness of the chassis member which are capable of supporting the vehicle or chassis over the support surface no matter which of surfaces of the vehicle or chassis is serving as the top or the bottom. The chassis is also configured to removably mount various body configurations in either orientations along the longitudinal axis of the chassis to stimulate the interest of the child. The vehicle has, thus, neither top nor bottom nor front nor rear in the classis sense. Finally, a separate battery pack of a size approximating a pair of 1.5 volt "C" batteries provides a control button that can within a matter of a few seconds or less time provide a recharging of the miniature battery to permit the toy vehicle to operate at relatively high speeds for a period of approximately 15 seconds. Charging the battery for a period of 15 seconds will drive the toy vehicle for approximately 60 seconds.

The object and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 2 is a side perspective view of the chassis member and a removable vehicle body of the present invention;

FIG. 3 is a bottom view of the chassis member;

FIG. 4 is a right side elevational view of the chasis member which is a mirror image of the left side view;

FIG. 5 is a front elevational view of the chassis member;

FIG. 6 is a rear elevational view of the chassis member;

FIG. 7 is a bottom view of the top portion of the chassis member;

FIG. 8 is a top view of the bottom portion of the chassis member;

DESCRIPTION OF THE PREFERRED EMBODIMENT

The following description is provided to enable any person skilled in the toy industry to make and use the invention and sets forth the best mode contemplated of carrying out the invention. Various modifications, however, will remain readily apparent to those skilled in the above art, since the generic principles of the present invention have been defined herein specifically to provide a relatively economical and easily manufactured toy vehicle.

The toy vehicle set of the present invention embodies the concept of providing an extremely small electrical toy vehicle having a total weight of about 17 grams that is not much longer of thicker than the component parts of the electric motor, connector or receptacle, rechargeable battery and switch. Also the invention encompasses the desirability of providing a toy vehicle of relatively high acceleration and velocity such as about 15 miles per hour that would operate longer than the conventional spring-driven lightweight toy vehicles that are currently on the market without approximating the running time of a toy vehicle carrying a conventional battery source. Additionally, the invention embodies the concept of providing a small electric toy vehicle which has neither top nor bottom nor front nor rear in the classic sence. Finally, as can be readily appreciated by a person skilled in this field, the present invention complies with the dictates of a relatively economical, easily manufactured toy product to withstand the rigors of the competitive pressures of the marketplace.

Figure 1:
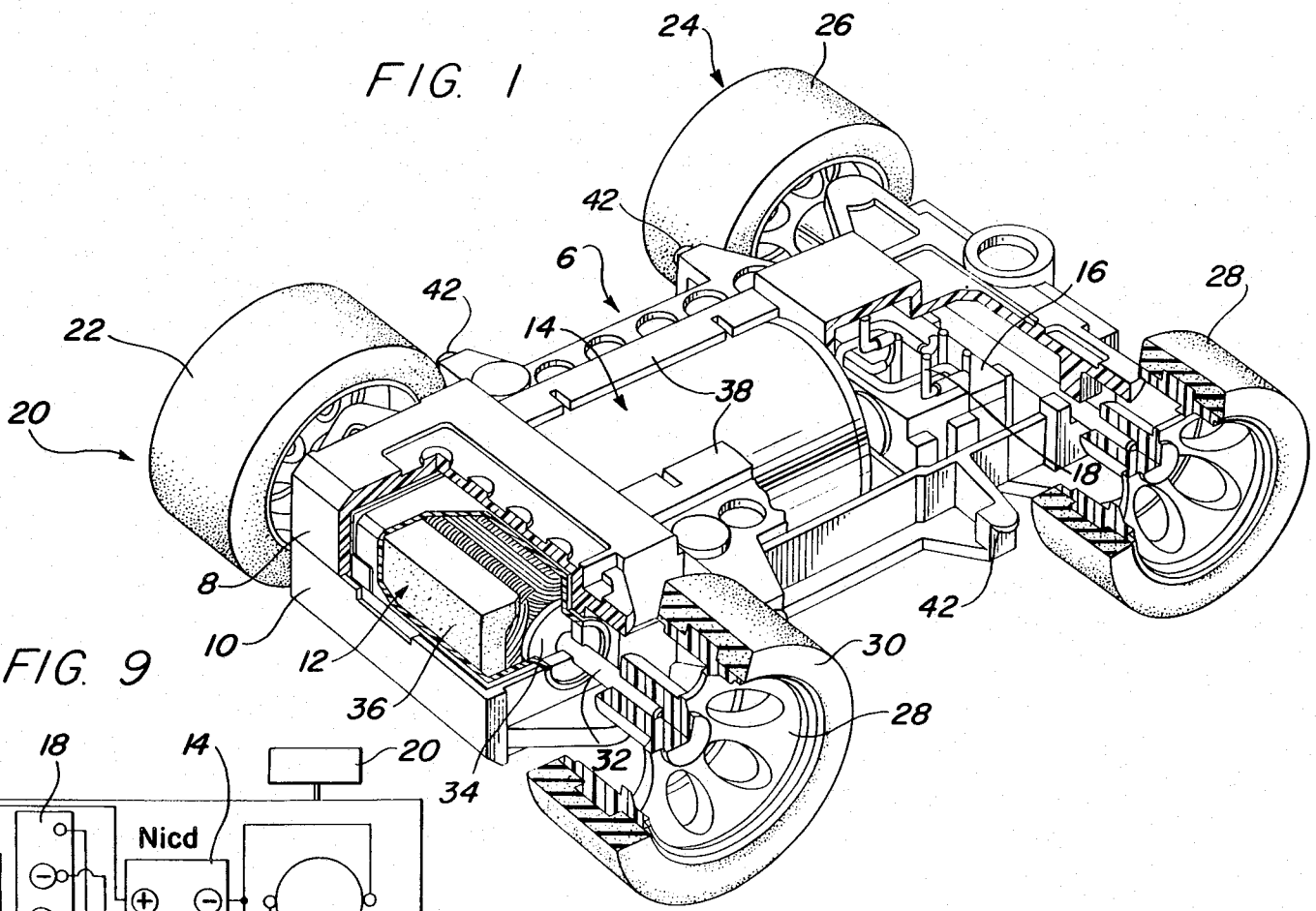
FIG. 1 is a partial side perspective view of the chassis member of the present invention.

Referring to FIG. 2, the toy vehicle 2 of the present invention is disclosed with one embodiment of a vehicle body configuration. The vehicle body 4 is removably mounted on a chassis member 6 which is more specifically disclosed in FIG. 1. The chassis 6 has been specifically designed to be formed from an upper chassis member 8 and a lower chassis member 10 having approximately the same exterior configurations. The interior portions of the respective upper and lower chassis members 8, 10 are designed to support at one end a direct current electric motor 12 having a capacity of maximum revolution of 20,000 r.p.m. and a weight of about 4 grams such as a miniature motor sold by the Sanwa Electric Co., Ltd., a centrally located rechargeable battery 14 such as a nickel cadmium battery sold by the Sanyo Electric Co., Ltd. as a Sanyo Cadnica of approximately 9/16 inch in length along the longitudinal axis of the chassis 6, ⅜ inch in diameter and 5 grams in weight, and a sliding switch 16 which can be included integrally or separately with a female receptacle connector 18 that provides means for recharging the battery from a source of an autonomous power supply (to be described later).

A front wheel assembly 20 includes a pair of front wheels 22 of a diameter greater than the thickness of the chassis member 6, as can be seen in FIGS. 4 and 5. A rear wheel assembly 24 also includes a pair of rear wheels 26 of a diameter greater than the thickness of the chassis member 6, as can be also seen in FIGS. 4 and 6. The front and rear wheel assemblies have, respectively, side conical wheel mounts 28 supporting cylindrical elastic tires 30 and the front wheel mounts 28 are mounted directly on a shaft or axle 32 that is connected to the rotor 34 of the electric motor 12. The rotor 34 is journalled within the armature 36 of electric motor 12. The upper and lower chassis member 8 and 10, respectively, provide appropriate notches for positioning or bearing the axle 32. The rear wheel assembly 24 is also appropriately journalled within bearing notches between the upper chassis member 8 and lower chassis member 10.

The rechargeable DC battery 14 is held in position by a pair of integral flexible slotted flanges 38 and 40 mounted respectively on the upper chassis member 8 and lower chassis member 10. These flanges not only support the battery 14 but can accommodate small manufacturing variances in the diameter of the battery.

As can be seen from FIGS. 3 and 4, the fore end of the front wheels 22 is slightly projected outside the fore end of the chassis 6 and also the rear end of the rear wheels 26 is slightly projected outside the rear end of the chassis 6. This allows the wheels 22, 26 to bump against an obstacle prior to the front or rear end of the chassis 6 when the toy vehicle bumps against the obstacle, and enables the toy vehicle to change the running-direction automatically with a bumper-effect by the elasticity or resiliency of said wheels.

Figure 9:
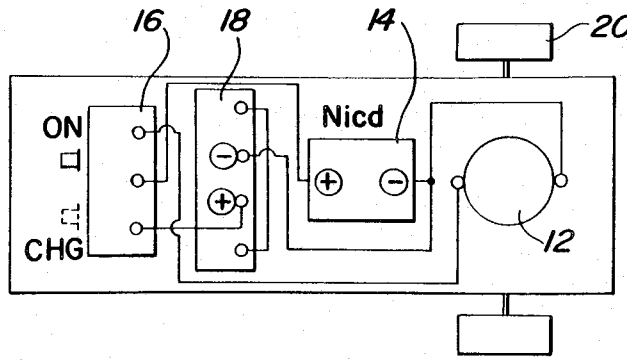
FIG. 9 is a schematic of the vehicle and electric circuitry.

As can be seen from FIG. 9, the switch 16 is a sliding three-terminal switch, that either connects the battery 14 to the motor brushes of the motor 12 or connects the terminals of the battery 14 to the terminals of the female receptacle connector 18.

Figure 10:
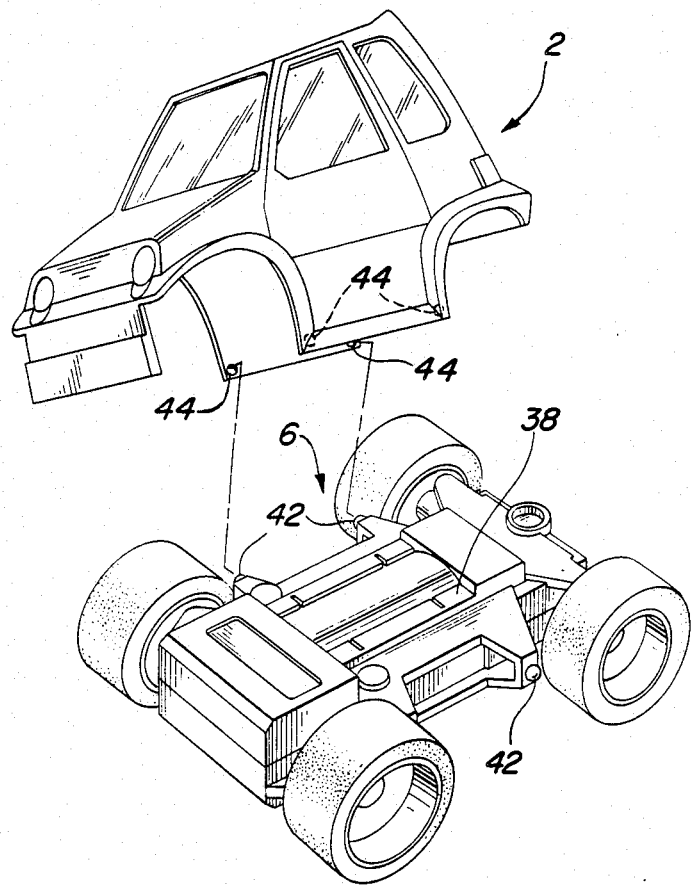
FIG. 10 is a partial exploded view of the vehicle chassis and body member.

On either side of the chassis 6 are a set of male prongs 42 that are designed for a snap mounting or friction fit mounting of a vehicle body member 4 to the chassis 6. As can be seen in FIG. 10, the vehicle body member, which can be of any subjective configuration compatible with the chassis 6, carries a complementary set of interior female notches or cavities 44 for interaction with the male prongs 42 of the chassis 6. As can be appreciated, the chassis 6 has neither top nor bottom nor front nor rear in the classic sence, and capable of attaching the chassis 6 to the body member 4 reversibly serving neither as the top and bottom of the chassis 6, nor as the front and rear of the chassis 6 in the different orientations along the longitudinal axis of the chassis 6. As can be also appreciated, it is envisioned that a plurality of different vehicle body styles can be mounted on a universal chassis 6. It shall also be appreciated that the vehicle body 4, the upper chassis member 8, lower chassis member 10 and wheel mounts 28 are to be molded from a plastic that also provides certain resilient capacities such as permitting the snap mounting of the vehicle body 4 to the chassis 6.

The respective upper and lower chassis members, 8 and 10, can be held together by a set of screws such as Philip head screws 46 shown in FIG. 3 to securely capture and fasten the rechargeable battery 14, electric motor 12, female receptacle connector 18, and switch 16 in an operative relationship. As can be seen from FIGS. 7 and 8, the chassis members are appropriately configures with partitions or compartments 56, 58, 60 and 62 to juxtaposition the respective operative parts of the toy vehicle 2, motor 12, battery 14, connector 18 and switch 16 within the chassis 6.

Figure 11:
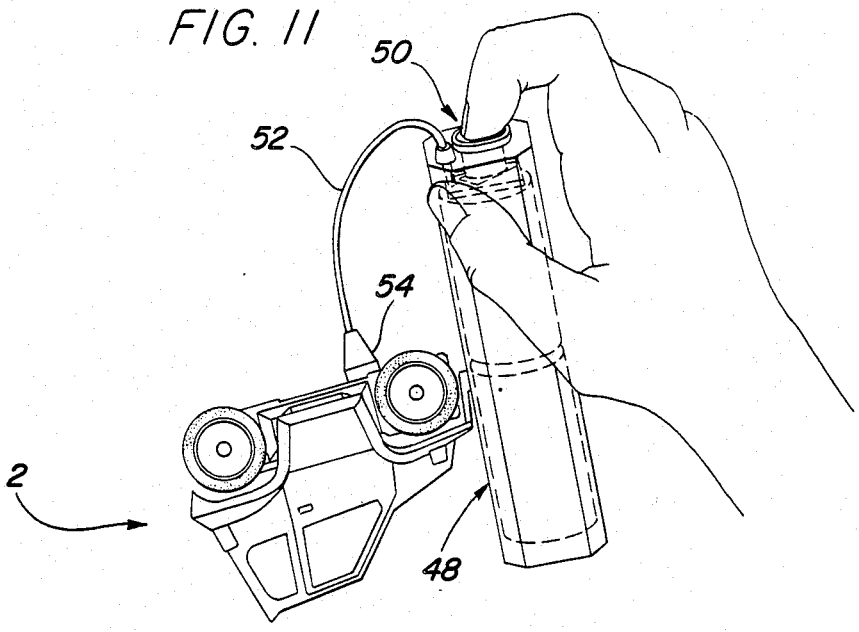
FIG. 11 is a perspective view of the toy vehicle set with a connection to its primary battery power source.

Referring to FIG. 11, a separate hand holdable elongated body member or battery pack 48 is provided to mount approximately two 1.5 volt DC batteries, size "C". A spring-loaded pushbutton contact terminal switch or control button 50 can connect the primary batteries via a power line 52 to a male plug or connector 54. As can be appreciated from FIG. 9, the switch 16 must be turned to the charge, "CHG" position and it is only necessary to momentarily, 1 or 2 seconds, hold the pushbutton switch down for electrical contact with the primary batteries to recharge the battery 14 with sufficient electrical power to drive the toy vehicle for approximately 15 seconds. Generally the maximum battery charge requires about 30 seconds to operate the vehicle for 120 seconds. The rechargeable battery 14 is made by the Sanyo Electric Co., Ltd. as Model No. MN-50AAA having 1.2 volts at 50 mAh and is capable of providing a standard charge of 5 mA for a period of 14 to 16 hours. The power load provided by the electric motor 12, however, exhausts the charge on the battery 14 within approximately 15 seconds. Rechargeable battery 14, however, is continually reusable and can be recharged from a normal 1.5 volts DC "C" size battery for a large number of play actions by the child. The child thus enjoys a longer play than is generally conventionally provided by the comparatively same size spring-driven motors while maintaining a lightweight, high acceleration vehicle that can be used alone or in combination with various play sets such as tracks to provide enjoyment to a young child. Previous rechargeable toy batteries have generally required a substantial time period for recharging and have provided operative versus charging ratios of 2 to 4 times, e.g., charge for 30 seconds and operate the toy vehicle for 1 minute. The present invention permits an apparent instantaneous recharge with an operative ratio of 10 to 15 times. Thus the present invention, by providing an extremely small vehicle, provides a child with a play action of 10 to 15 seconds with minimal recharging time.

As can be readily appreciated, the present invention provides numerous play options which are only limited by the imagination of the child, while permitting the manufacturer to enjoy a relatively easily manufactured and competitive product. In view of the versatile capabilities of the present invention and the ability of people skilled in this toy field to create variations once disclosed to the generic principles of the present invention, the scope of the present invention should therefore be measured solely from the following claims.

What is claimed is:

1. An electric toy vehicle with a rechargeable battery comprising:

a chassis member extending along a longitudinal axis and having an upper and lower portion of approximately the same exterior configurations and having a fore end and rear end positioned at opposite ends of the longitudinal axis;

a front and rear wheel assembly including wheels mounted on the chassis, each wheel being dimensioned with a diameter that is greater than the maximum distance between the upper and lower portions of the chassis member;

a rechargeable battery mounted within the chassis;

an electric motor mounted within the chassis and electrically connected to the battery;

means for recharging the battery from a source of power; and at least one removable vehicle body, one of the chassis member and vehicle body having a set of male type connectors and the other having a set of female type receptacles for snap mounting of the vehicle body on the chassis member in a position that interfaces either the upper or lower portion of the chassis member.

2. The invention of claim 1 wherein the means for recharging the battery includes a manual switch mounted on the chassis and a connector, the battery terminals aligned parallel with the longitudinal axis, the overall length of the chassis approximately the width of the motor, connector and switch plus the length of the battery.

3. The invention of claim 2 wherein the electrical characteristics and weight of the vehicle permits a recharge time of approximately 1 second with a subsequent vehicle operation of greater than 10 seconds.

4. The invention of claim 3 wherein the rechargeable battery can provide 14 to 16 hours at 5 mA and the second primary battery source is a pair of 1.5 volts DC size C batteries.

5. The invention of claim 1 further including a separate hand-held body member having a power line, a second primary battery and a connector for providing power to the means for recharging, the body member further having a spring-biased button for control by an operator to electrically connect the second battery to the power line.

6. A miniature electric toy vehicle set with a rechargeable battery comprising:

a chassis member having an upper and lower portion, the chassis member being further configured and dimensioned to engage a body member which may thereby interface either the upper or lower portion;

a front and rear wheel assembly including wheels mounted on the chassis;

a first rechargeable battery mounted within the chassis and having a characteristic of providing 5 mA of current for a time period of approximately 14 hours;

an electric motor mounted within the chassis and electrically connected to the battery for propelling the toy vehicle at approximately 15 miles/hour;

a manual switch mounted on the chassis for operation by an operator to enable the vehicle to be recharged;

a first connector mounted on the chassis and electrically connected to the rechargeable battery; and means for recharging the battery from a source of power, including a separate hand-held body member supporting a second battery source having a pair of 1.5 volt DC size C batteries, a power line, a second connector plug mounted on the chassis, the body member further having a control button for control by an operator to electrically connect the second battery source to the power line.

7. The invention of claim 6 wherein the electrical characteristics and weight of the vehicle permits a recharge time of approximately 1 second with a subsequent vehicle operation of greater than 10 seconds.

8. The invention of claim 7 wherein the chassis member has an upper and lower portion of approximately the same exterior configuration.

9. The invention of claim 8 wherein the vertical thickness of the chassis member is less than the diameter of the wheels.

10. A small electric toy vehicle with a rechargeable battery comprising:

a chassis having a longitudinal axis and an upper and lower portion;

a front and rear wheel assembly including wheels mounted on the chassis, the diameter of the wheels being greater than the vertical thickness measured between the upper and lower portions of the chassis;

a first rechargeable battery mounted within the chassis and having terminals aligned parallel with the longitudinal axis;

an electric motor mounted within the chassis and electrically connected to the first battery;

means for recharging the first battery from a source of power, including a manual switch mounted on the chassis and a first connector;

a removable vehicle body, one of the chassis and vehicle body having a set of male type connectors and the other having a set of female type receptacles for snap mounting of the vehicle body on the chassis;

a separate hand-held body member having a power line;

a second primary battery source mounted in the body member; and a second connector attached to the second primary battery source for providing power to the means for recharging, the hand-held body member further having a control button for control by an operator to electrically connect the second battery to the power line and the length of the chassis being approximately equal to the width of the motor, first connector, manual switch, and length of the first battery.

11. The invention of claim 10 wherein the upper and lower chassis portions have approximately the same exterior configurations.

12. The invention of claim 10 wherein the first connector is mounted on the lower portion of the chassis adjacent a wheel assembly and the manual switch is positioned adjacent the first connector whereby the operator inverts the vehicle to recharge the battery within the chassis.

* * * * *